United States Patent [19]

Torisu

[11] 4,216,874

[45] Aug. 12, 1980

[54] WELD ASSEMBLED TANK

[76] Inventor: Kiwa Torisu, No. 35-1, 3-chome, Maebara-higashi, Hunabashi-shi, Chiba-ken, Japan

[21] Appl. No.: 964,602

[22] Filed: Nov. 29, 1978

Related U.S. Application Data

[63] Continuation of Ser. No. 810,182, Jun. 27, 1977, abandoned.

[51] Int. Cl.² ..... B65D 7/02; B65D 7/42

[52] U.S. Cl. ..... 220/5 A; 220/67

[58] Field of Search ..... 220/5 A, 1 B, 66, 67, 220/69

[56] References Cited

U.S. PATENT DOCUMENTS

| | | | |
|---|---|---|---|
| 1,496,585 | 6/1924 | Mangrum et al. | 220/5 A |
| 1,773,930 | 8/1930 | Athon | 220/5 A |
| 1,966,244 | 7/1934 | Hansen | 220/5 A |
| 2,223,713 | 12/1940 | Zigler | 220/1 B |
| 2,301,061 | 11/1942 | Logeman | 220/67 X |
| 2,592,419 | 4/1952 | Harper et al. | 220/5 A |
| 2,634,878 | 4/1953 | Messinger et al. | 220/5 A |
| 2,953,278 | 9/1960 | Kaul | 220/67 |
| 3,186,583 | 6/1965 | Zundel | 220/66 |

*Primary Examiner*—Steven M. Pollard

*Attorney, Agent, or Firm*—Toren, McGeady and Stanger

[57] ABSTRACT

A weld assembled tank comprising;

(a) a disc-like base plate, (b) an annular supporting plate superposed on the base plate, said annular supporting plate being welded to the base plate, at its outer circumferential edge with its inner circumferential edge being free, and (c) a cylindrical shell plate erected on the supporting plate, the lower end of said shell plate being welded to the supporting plate at both its inner and outer circumferential sides.

10 Claims, 22 Drawing Figures

FIG. 11 NEW STRUCTURAL FORMATION OF RECTANGULAR BOTTOM CORNER IN CYLINDRICAL TANK (DOUBLE ANNULAR SYSTEM)
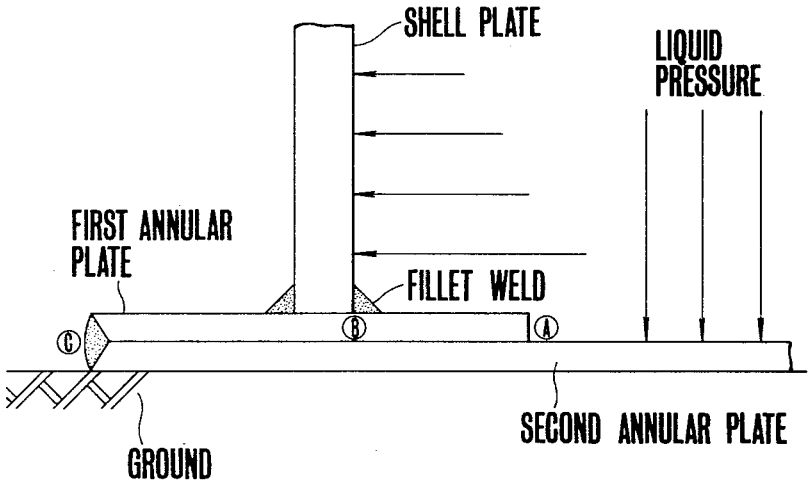

FIG. 12 PROFILE OF DEFORMATION WHICH TAKES PLACE AT THE RECTANGULAR BOTTOM CORNER OF DOUBLE ANNULAR SYSTEM UNDER STATIC LIQUID PRESSURE
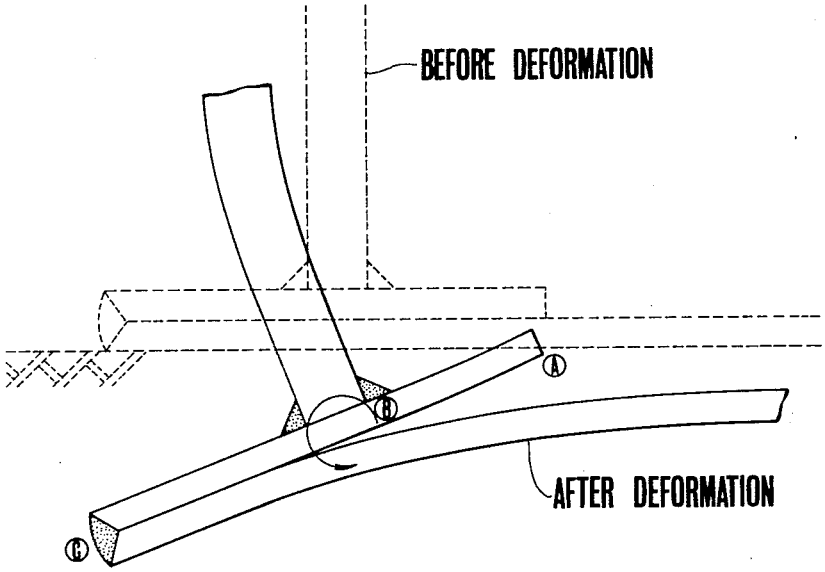

FIG. 13 STATUS OF LOAD
(a)
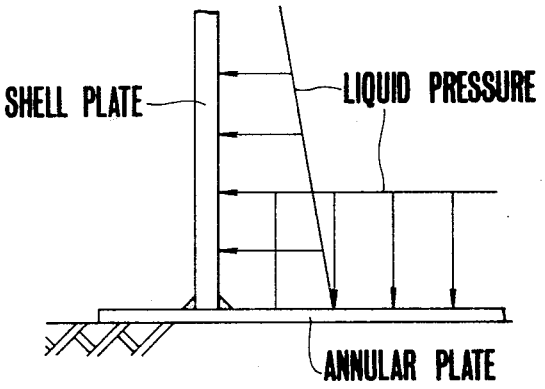
(b)
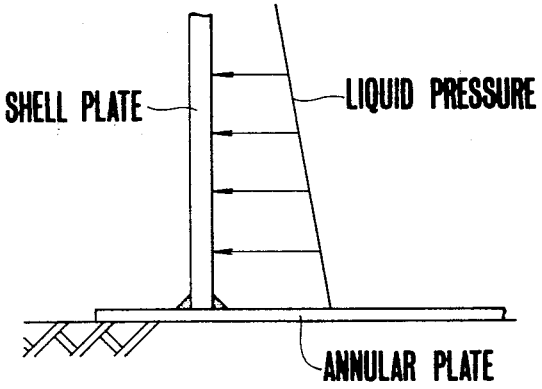

FIG. 14 AN ANARYTICUL MODEL OF STRESS
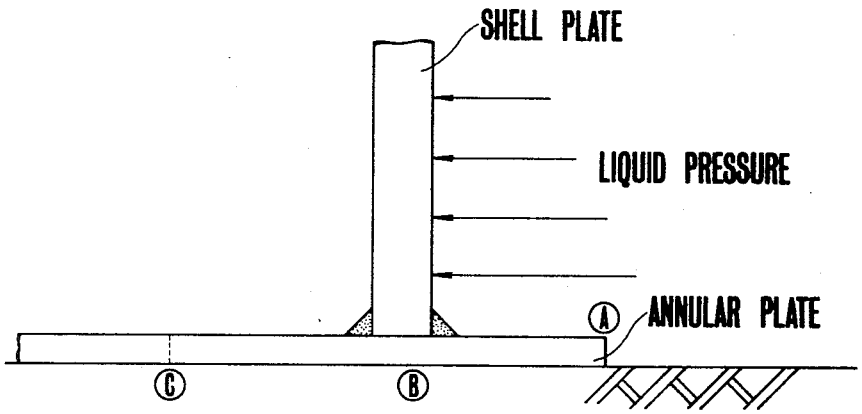

FIG. 15 DISTRIBUTION OF LOCAL BENDING STRESS IN ANNULAR PLATE
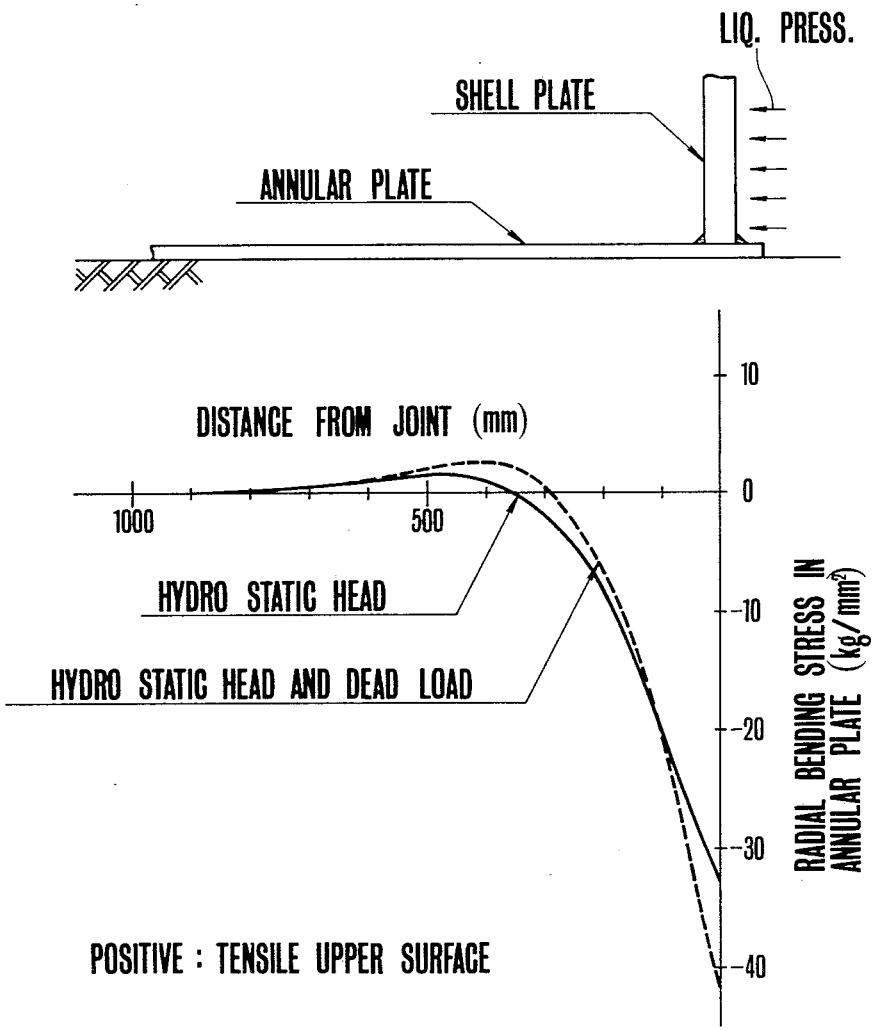

FIG. 16 RELATION OF THE EXTRA LENGTH $\ell$ THE FIRST ANNULAR PLATE TO THE MAX. LOCAL BENDING STRESS AT RECTANGULAR BOTTOM CORNER
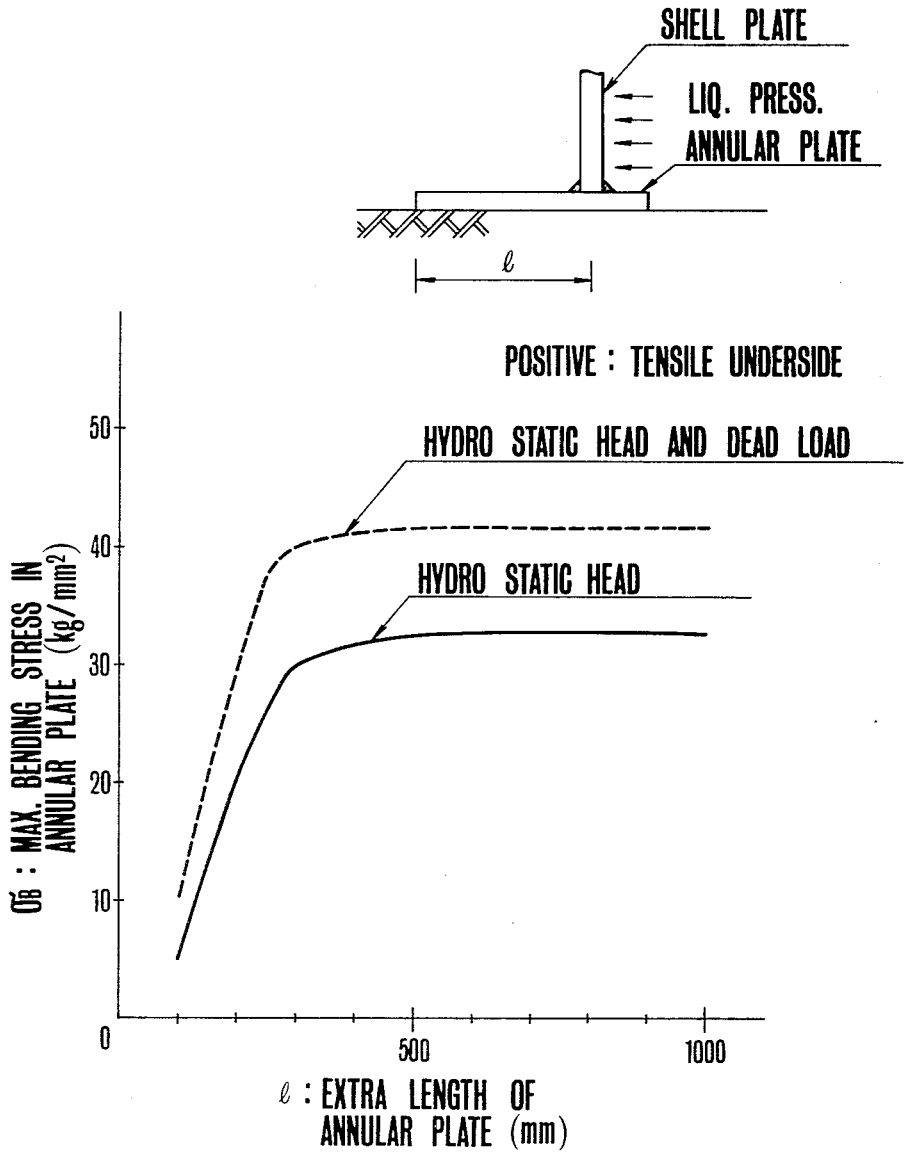

WELD ASSEMBLED TANK

This is a continuation of application Ser. No. 810,182 filed June 27, 1977, now abandoned.

BACKGROUND OF THE INVENTION

1. Field of the Invention

This invention relates to a weld assembled tank for storage of a liquid such as heavy oil, petroleum, etc. and a method for fastening a shell plate through a supporting members to a base plate in a such weld assembled tank.

2. Description of the Prior Art

In the conventional construction of a storage tank of the type referred to the above, arched shell plates are erected directly on the base plate and the lower end of the former is welded to the latter with fillet weld applied to both the inner and outer surfaces of the joints. However, with a liquid stored in the tank, when a deformation of the tank takes place with a part of or the whole of the tank base coming to subside or the shell plates coming to buldge, a tensile force is imposed on the fillet welded part at the lower end of the inner circumference of the tank in the direction of opening the fillet welded part. Then, this tends to cause cracks in such a part which is loaded with the tensile force or peel off the welded part and then the stored liquid begins to leak. Such leakage tends to lead to very serious trouble.

Since such leakage is dangerous also in terms of environmental pollution or public nuisance, there has been an urgent demand for an improvement over the conventionally employed method of joining shell plates on to base plate of such storage tanks.

SUMMARY OF THE INVENTION

It is an object of this invention to provide a weld assembled tank which effectively prevents the above stated trouble in which the weld joint parts are reinforced to remove the shortcoming of the conventional arts.

In short, in accordance with this invention, the shortcoming of the conventional arts whereby a shell plate is directly fillet welded to a tank base plate is eliminated by arranging many arched shape-steel members having a cross sectional form of an L, reversed L-shape, inverted T, flat bar etc., in a circle along the peripheral edge of a disc-like base plate which is either put on a sketch plate laid on the foundation surface at a weld assembled tank construction site or directly put on the foundation surface; then, by butt welding, the confronting end faces of abutting shape steel members are welded together and the inner circumferential edge face in the flange portion of each of these shape steel members is welded to the outer circumferential end face of the base plate while the upper end of each shape steel member is welded to the lower end face of the lowest shell plate; and, further, the lower edge portion of the outer circumference of each shape steel member is welded to the peripheral edge of the sketch plate by welding. Then, the device of this invention for carrying out the above stated method comprises the sketch plate which is arranged to have the peripheral edge portion of the base plate of the weld assembled tank laid thereon; an annular plate which is disposed on the peripheral edge of the sketch plate; and shape steel members having a cross sectional form such as a L-shape, a reversed L-shape, an inverted T-shape, and a flat bar, etc.

The above and further objects, advantages and features of this invention will become apparent from the following detailed description of preferred embodiment taken in conjunction with the accompanying drawings.

BRIEF DESCRIPTION OF THE DRAWINGS

FIGS. 11 to 16 are drawings for explaining the stress analysis in the weld assembled tank according to the present invention.

DESCRIPTION OF THE PREFERRED EMBODIMENTS

Figure 1:
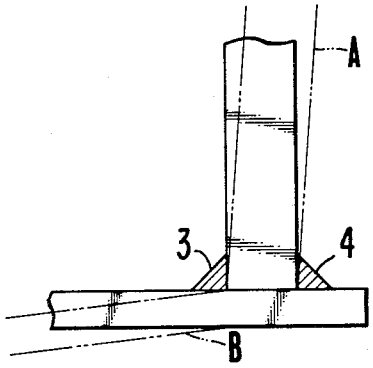
FIG. 1 is a sectional view illustrating essential parts of an example of the conventional method of welding a shell plate on to a tank base plate.
Figure 2:
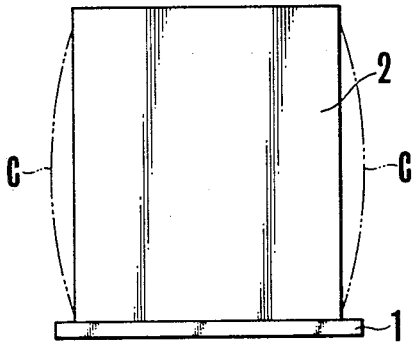
FIG. 2 is a front view illustrating a tank constructed in accordance with such a method.

To prove the advantages of the fastening method of this invention over the conventional method, FIG. 1 illustrates the conventional method for comparison. What is illustrated in FIG. 1 is the part where the lowest shell plate is joined on to a tank base plate by the conventional method. A reference numeral 1 indicates a disc-like base plate; and 2 indicates a shell plate. The lower end of the shell plate is secured to the base plate 1 by means of a fillet weld part 3 on the inner side of the tank and another fillet weld part 4 on the outer side. When a liquid content is stored in such a tank, the tank begins to swell out into a barrel like shape as shown by a chain line C in FIG. 2. Accordingly, the joint part between the shell plate 2 and the base plate is deformed as indicated by a chain line A in FIG. 1. Then, a tensile force acts on the fillet weld part 3 in the direction of widening the joining angle. Since this tensile force varies with decrease and increase of the stored liquid quantity, the tensile force varies every time the liquid is supplied to or discharged from the tank. Therefore, frequent repetition of such charging and discharging operations tends to bring about cracks in welded parts. In addition to that, when a natural phenomenon such as an earthquake or a subsidence of the ground takes place causing a deformation of the base plate 1 as indicated by a chain line B, a tensile force also acts on an inner fillet weld part 3 in the same manner as in the case of the above stated frequent charging and discharging operations and such also tends to cause cracks in welded parts.

Figure 3:
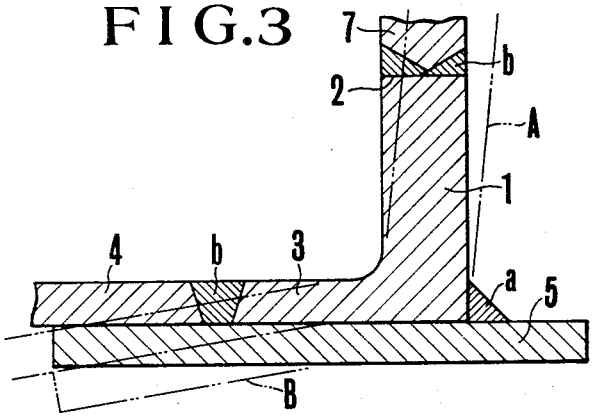
FIGS. 3 to 10 are sectional views respectively illustrating the essential parts of embodiments of this invention wherein welding is carried out using the shape steel members of the invented device according to their different shapes.

FIGS. 3 through 8 respectively illustrate different embodiment examples of the device usable for carrying out the method of this invention. In FIG. 3, a reference numeral 5 indicates a sketch plate which is laid on the foundation surface; and 4 indicates a disc-like base plate which is placed on the sketch plate 5. Many shape steel members 1 each being formed into an arc form and each having a cross sectional shape of a reversed L-shape are arranged in a circle along the peripheral edge of the disc-like base plate. Then, by butt welding, the confronting end faces of abutting shape steel members are secured to each other and the inner circumferential face of the flange portion of each shape steel member to the outer circumferential face of the base plate while the upper end of each shape steel member 1 is secured to the lower end face of the lowest shell plate 7. Further, the lower edge portion of the outer circumference of each shape steel member 1 is secured to a sketch plate 5 by a fillet weld part a.

Figure 4A:
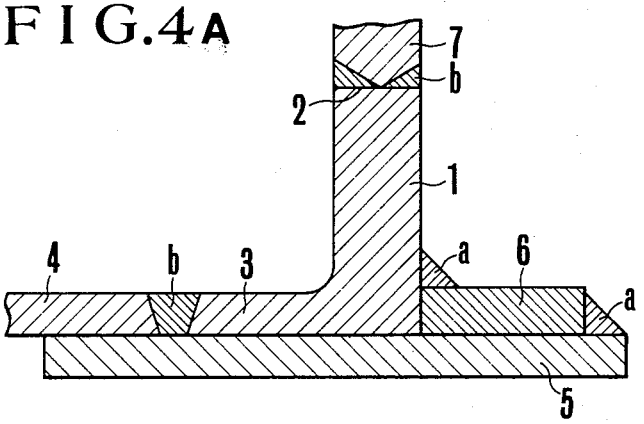

In the case of the embodiment shown in FIG. 4A, an annular reinforcement plate 6 is connected to the lower part of the outer circumference of each shape steel member 1 having a cross sectional reversed L-shape and is secured to the shape steel member 1 and to a sketch plate 5 by means of fillet weld parts a, respectively. Such arrangement, not only enhances the strength of the above stated joint parts but also facilitates tank assembling work, and may be made in the other embodiments shown in FIGS. 3, 4B, 5A, 6, 7, 8, 9A and 10.

Figure 4B:
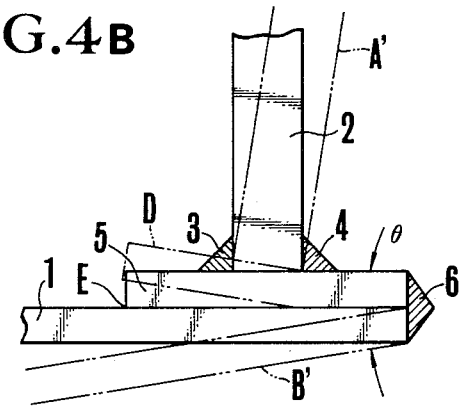

In another embodiment shown in FIG. 4B, supporting plates 5 overlap one another on a disc-like base plate with their outer circumferential ends aligned with each other. The lowest shell plate 2 is put on the supporting plates 5. The lower end of the shell plate 2 is joined on to the supporting plate 5 by fillet weld parts 4 and 3 at outer and inner edges thereof. Each supporting plates 5 is secured to the outer circumferential edge of the base plate by a weld part 6. However, the inner circumferential edge portion E is just joined on to the base plate 1 without welding in such a manner that it is left freely detachable therefrom.

Figure 4C:
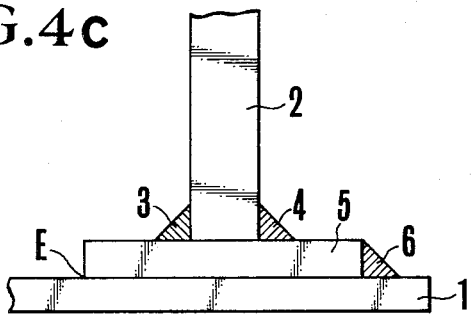

In the case of FIG. 4C, the outer diameter of the supporting plate 5 is arranged to be smaller than that of the base plate 1 to facilitate welding work at the construction site while its outer circumferential edge is secured to the peripheral face of the base plate 1 by fillet weld 6. However, the effect attainable by the embodiment example shown in FIG. 4C is almost the same as the embodiment shown in FIG. 4B.

In each of the above stated embodiments, when the whole or a part of the base plate 1 comes to curve as shown by a chain line B' in FIG. 4B due to subsidence of the ground after construction of the tank, the supporting plate 5 is not displaced together with the base plate 1 and is still kept in the set place because it is not welded to the base plate 1. Therefore, there is no tensile force acting on the fillet welded part 3 to prevent a serious trouble that otherwise results from a cut or peeling of such a fillet welded part.

When the constructed tank is filled up with stored liquid and when this causes the shell plate 2 to be deformed swelling out as indicated by a chain line A' in FIG. 4B, an aslant curved deformation of the supporting plate 5 takes place on a point close to the welded part 4 as indicated by a chain line D, so that there is no tensile force acting on the welded part 3 at the inner circumferential edge portion of the supporting plate 5.

Although a compressive force then comes to act on the fillet welded part 4 and the welded part 6, such a compressive force causes no problem, because a welded part is much stronger against a compressive force than against a tensile force.

Further, a measuring datum point is set at a suitable position on a shell plate of the tank for measurement of variation in the angle 0 between the upper face of the supporting plate or member and the lower face of the base plate, any subsidence of the base plate or the foundation can be detected without breaking the shell plate from outside, so that a serious trouble can be prevented.

Figure 5A:
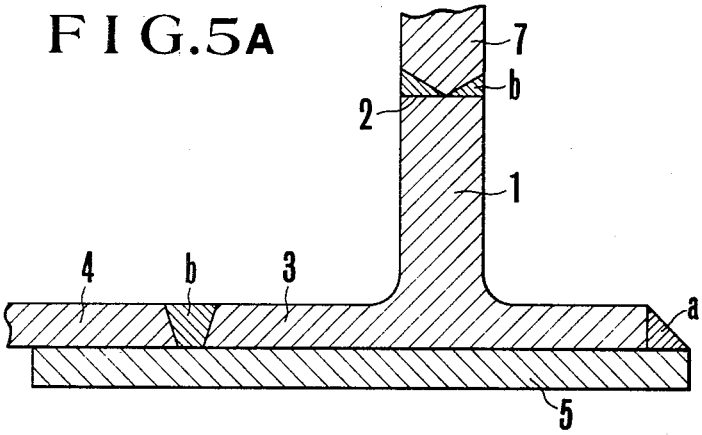

In the embodiment illustrated in FIG. 5A, a sketch plate 5 is laid on the foundation. A disc-like base plate 4 is placed on the sketch plate 5. A shape steel member 1 having a cross sectional form of an inverted T-shape is superposed on the sketch plate 5 along the outer circumferential edge of the base plate 4. The upper face of the outer circumferential edge portion of the sketch plate 5 is welded to the outer end face of the outer flange portion of the shape steel member 1 by fillet weld, a. Butt weld, b, is employed for joining the inner end face of the inner flange portion of the shape steel member 1 on to the outer circumferential end face of the base plate 4 and also for joining the upper end face of the shape steel member 1 to the lower end face of the lowest tank shell plate 7.

Figure 5B:
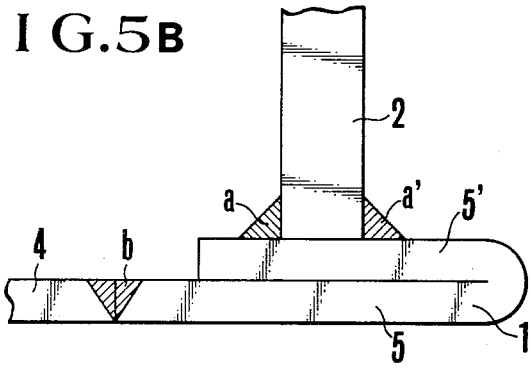

FIG. 5B illustrates a modification of the structural arrangement shown in FIG. 4B. In this case, the outer circumferential edges of annular plates 5 are bent upward and superposed on one top of the other. With the first and second annular plates 5 and 5' formed and arranged in this manner, the inner circumferential end face of the first annular plate 5 which is disposed below the second plate 5' is welded to the outer circumferential end face of the base plate 4 by butt weld b. The upper face of the second annular plate 5' which is disposed on the first plate 5 is welded to the lower end of a tank shell plate 2 both on the inner and outer sides thereof by fillet weld a and a'.

Figure 5C:
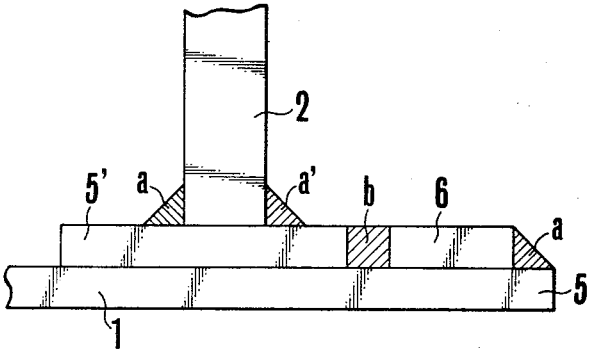

FIG. 5C illustrates another modification of the structural arrangement shown in FIG. 4C. In this case, instead of bending up the outer circumferential edge of the first annular plate 5 and pressing the second annular plate 5' against the first plate 5 as in the case of FIG. 5B, an annular reinforcement plate 6 is superposed on the upper face of the outer circumferential edge portion of the first annular plate 5. Then, the second annular plate 5' is laid on the first annular plate 5 along the inner circumferential edge of the reinforcement plate 6. The inner circumferential end face of the reinforcement plate 6 is connected by butt weld b to the outer circumferential end face of the second annular plate 5'. Further, by fillet weld a and a', the outer circumferential end face of the reinforcement plate 6 is joined to the upper face of the outer circumferential edge portion of the first annular plate 5 and both the inner and outer corner parts which are formed by placing the lower end of the tank shell plate 2 on the upper surface of the second plate 5' are welded. With a reinforcement plate 6 welded to the outer circumference of the annular plate 5' in such a manner, the tank has a stronger resistance to a force of horizontal inertia caused by an earthquake. The use of the reinforcement plate 6 is also applicable to all other embodiments described in the foregoing.

As for the shape steel members, there are commerically available shape steel materials measuring more than 300 mm in the length of horizontal flange portions while they vary in the thickness of their vertical flange portions. Suitable shape steel members having a greater thickness than that of the tank shell plates 2 must be selected and used by alligning them with the inner circumferential face of the shell plates 2.

It is possible to prevent water from coming in between the supporting plate and the base plate by filling and applying some suitable material such as water glass or a fluorinated calking material to the contacting part between the free end portion of the second annular plate and the base plate, even when the supporting plate and the base plate are separated due to the above mentioned subsidence or swelling, because this material seals the gap between the supporting plate and the base plate.

The use of a suitable calking material for such a purpose also gives a great anticorrosion effect.

The structural arrangements shown in FIG. 5A and FIG. 5B have a much greater strength than those shown in FIG. 3 and FIG. 4. Besides, in the case of FIG. 5B, the first and second annular plates 5 and 5' are just pressed together into one united body without welding them together. With such arrangement, a local concentration of stress caused by welding can be prevented at their bent parts.

Figure 6:
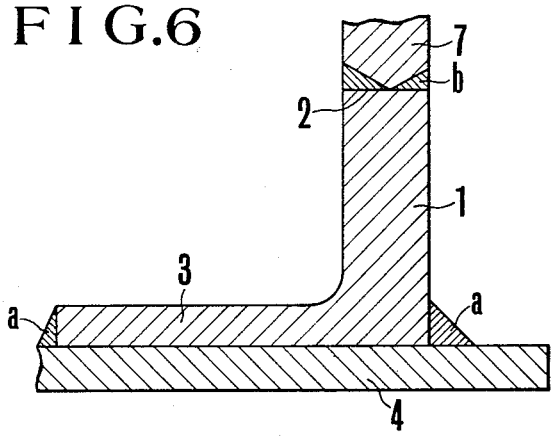
Figure 7:
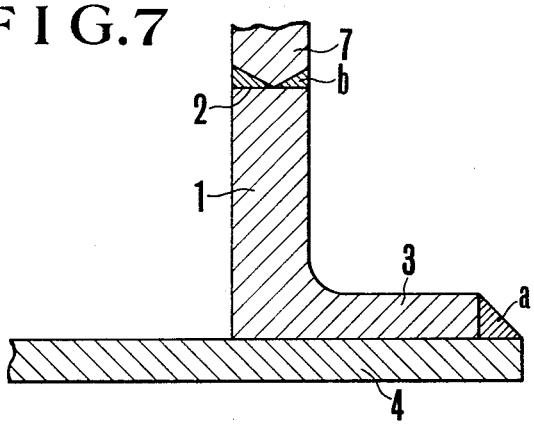
Figure 8:
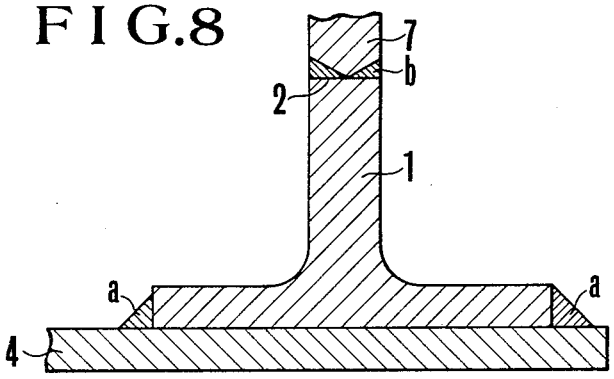

In the embodiments shown in FIGS. 6, 7 and 8, the lower face of the flange portion in a shape steel member 1 having a cross sectional form of a L-shape, a reversed L-shape or an inverted T-shape is joined on to the upper surface of the base plate 4 and is secured thereto by fillet weld a. This arrangement simplifies the structure and makes construction work easier.

As described in the foregoing embodiments and modification examples, the device of this invention comprises the supporting plates, annular plates and shape steel members having a cross sectional form of a L-shape, a reversed L-shape or an inverted T-shape with these members welded together. Then, with a tensile force acting on the inner circumferential corner at the tank bottom, such a tensile force is received and borne by the shape steel members. Compared with the welded parts made by the conventionally known methods, the arrangement made in accordance with this invention is much stronger against a tensile force and is durable for a longer period of time.

Further, in construction of a tank, the shape steel members which not only can be readily arranged into a true circle but also are light weighted are laid on the base plate; shell plates are put on top of these shape steel members one after another into a cylindrical form; and then each joint part is secured by welding. By such processes, the construction work can be very easily and correctly accomplished.

Figure 9A:
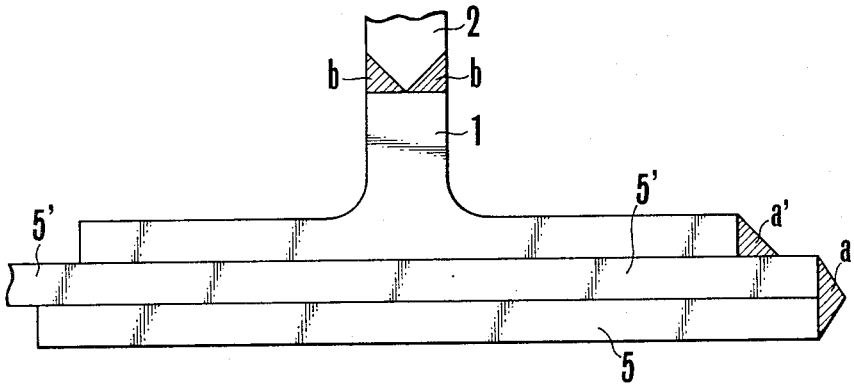

FIG. 9A illustrates another modification of the embodiment shown in FIG. 5A. In this modification, the annular plate 5' is placed on the upper face of the sketch plate 5 with the outer circumferential edges of the two plates aligned with each other; the shape steel member 1 having a cross sectional form of an inward T-shape is put on the annular plate 5' with the outer circumferential flange portion of the former set back from the outer circumferential edge of the latter. The aligned outer circumferential edge faces of the sketch plate 5 and the annular plate 5' are welded to each other and the upper surface in the outer circumferential edge portion of the annular plate 5' to the edge face in the outer circumferential flange portion of the shape steel member by fillet weld a and a', respectively.

In accordance with the embodiment shown in FIG. 9A, the tank shell plate is not directly welded to the annular plate but is connected to the annular plate through the shape steel member. Therefore, the parts where there develops a locally concentrated bending stress, such as outer or inner circumferential corner and the lower faces thereof, are formed by a shape steel member in one solid unit such as reversed L or inverted T shape steel, which does not have any welded part and is free from the heat effect of welding. Therefore, these parts are strong against such a concentrated stress and will never be broken or cracked.

The shape steel member of the invented device is preferably selected out of commercially available high tensile type steel materials according to the thickness of the tank shell plate and is used after machining both edges thereof. Each tank shell plate used for the lowest layer of the tank wall in general measures 30–50 mm in thickness and 1.5 m×9 m in length and width. Since the shell plates are heavy, much labor is required for aligning them in a predetermined circumferential position. However, compared with these shell plates, the above stated shape steel members of a L-shape or inverted T-shape weight lighter and can be more readily arranged into a circle when they have been prepared precisely to have a correct arc form. Then, a cylindrical tank wall can be easily constructed by placing shell plates on the circle formed by such shape steel members.

Figure 9B:
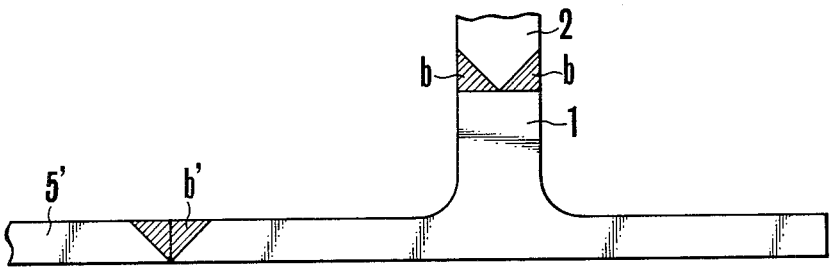
Figure 10:
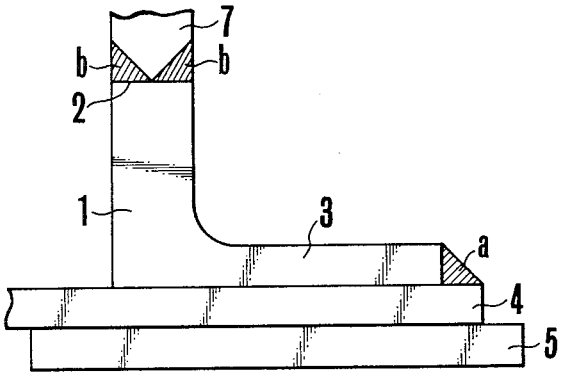

FIG. 9B illustrates a simplified modification of the structure shown in FIG. 9A. In this case, the shape steel member 1 is not laid on the annular plate 5'. Instead of such arrangement, the inner circumferential flange edge face is joined to the outer circumferential edge face of the annular plate 5' by butt weld b' while the upper end face of the vertical flange portion of the shape steel member 1 is joined to the lower end face of the lowest shell plate 2 of the tank also by butt weld b. Such structural arrangement permits easy assembling work.

Of the above mentioned embodiment examples, the structural arrangement of the cylindrical tank bottom corner which is provided with double annular plates has been subjected to various tests. The test results are as described below.

With a cylindrical tank having been assembled into the above stated structure, the stress at the bottom corner under a static liquid pressure which was the basic load was examined to obtain the following results:

1. Model Setting for Stress Analysis

When a cylindrical tank having a bottom corner arranged with double annular plates as shown in FIG. 11 is subjected to a static liquid pressure, it is deformed as illustrated in FIG. 12. In the vicinity of a point B, the maximum compression stress is developed in the annular plate at the lower end portion of the outer circumferential weld part between the shell plate and the first annular plate; while the maximum tensile stress develops at the lower surface of the annular plate immediately beneath the weld part. Although it depends on the distance between the points B and C, a local bending stress of the annular plate developed at the structural discontinuance point C decreases with distance to the point B and then changes its direction at the point C to attenuate further as it comes nearer to the inside of the tank.

In order to analyze the stress shown in FIG. 11, a model of the local bending stress developed at points B and C is set up. Under two types of loaded conditions as shown in FIG. 13, the difference in the local bending stress of the annular plate at the bottom corner parts of a cylindrical tank is about 5% in general unless there is some extraordinary local loss of a ground reaction. Accordingly, if the effect of the static pressure upon the annular plate can be considered negligible in the analysis of stress developed in the vicinity of the bottom corner part, there would be no problem if the continuity from the annular plate to the second annular plate is satisfactory. The structural model for analyzing the stress shown in FIG. 11 is therefore assumed to be as represented by FIG. 14 which shows the second annular plate with its end bent to the outside of the tank.

The main points of assumption made for analysis are as shown below:

(1) Micro-deformation elasticity analysis.
(2) The tank foundation ground is replaced with a uniform elasticity spring.
(3) The deformity of tank such as weld strain, etc. is disregarded.
(4) Inside-face stiffness is assumed to be infinite.
(5) Coefficient of subgrade-reaction is assumed to be 15 kg/cm$^3$.

2. Numerical Analysis

A stress in the vicinity of the bottom corner part formed with the double annular plates shown in FIG. 11 when the tank was under a static liquid pressure is analyzed with the tank being assumed to be in the following conditions:

| | |
|---|---|
| Specific gravity of the liquid content, $\gamma$: | 0.92/1000 kg/cm$^3$ |
| Liquid level, Hw: | 2253.63 cm |
| Radius of the tank, R: | 2616.45 cm |
| Thickness of the lowest shell plate: | 2.7 cm |
| Young's modulus, E: | $2.1 \times 10^6$kg/cm$^2$ |
| Poisson's ratio, v: | 0.3 |
| Coefficient of subgrade-reaction, ks: | 15 kg/cm$^3$ |

The distribution of the local bending stress under these conditions is as shown in FIG. 15. Referring to FIG. 15, the local bending stress quickly decreases as the distance from the point B at which the annular plate is joined to the shell plate increases. If the joining point between the first and second annular plates is set about 30 cm away from the shell plate, the local bending stress at such joining point C becomes so small and almost negligible.

Referring now to FIG. 16, when the extra length B—C of the outer circumference of the first annular plate shown in FIG. 11 is changed, the local bending stress that develops at the point C varies as shown in FIG. 16. In this case, the boundary condition at the point C is set to be free. As apparent from FIG. 16, when the distance between the points B and C are set to be more than 30 cm, the boundary condition at the point C is almost completely unaffected by the bending stress of the point B. In other words, the local bending moment (modulus of deflection) developed at the point B by structural discontinuity brings about almost no effect on the point C when the distance between the points B and C is set to be more than 30 cm. The numerical analysis shown in FIG. 15 and FIG. 16 indicates that the local bending stress which develops at the point C under a static liquid pressue can be lowered to a very small value by setting the weld point C at a suitable distance from the tank shell plate.

Through the above stated examination of the test results, it has been confirmed that the bottom corner part arranged with the double annular plates has the following advantages:

(1) At the joining point between the shell plate and the annular plate, the maximum tensile stress in the annular plate develops at the lower face of the annular plate beneath the weld part. Accordingly, there arises no extremely great peak tensile stress there.

(2) With the joining point between the first and second annular plates being set at a suitable distance from the shell plate, the local bending moment which develops at the joining point can be reduced to a very small value.

As described in the foregoing, it has become clear from the test results that the troubles which tend to take place when tank shell plates are joined on to a base plate in the conventionally employed manner can be very advantageously prevented in accordance with the invented device which comprises the fixing support members used for fastening the tank shell plates to the base plate. Therefore, in accordance with this invention, the problem of preventing such troubles that would result in serious environment pollution and a public nuisance can be most effectively solved.

What is claimed is:

1. A generally cylindrical, upright weld-assembled tank, particularly suited for storing liquids comprising, in combination: a bottom formed to include a substantially planar base plate having a generally disc-shaped configuration; an annular supporting member having a radially inner circumferential edge and a radially outer circumferential edge superposed over said base plate; and an upstanding generally cylindrical side wall formed from a cylindrical shell plate having an inner side and an outer side and a bottom edge superposed directly upon said annular supporting member and rigidly joined thereto, said shell plate being joined to said annular supporting member along said bottom edge thereof with said annular supporting member having said radially outer circumferential edge integrally joined to said base plate with said radially inner circumferential edge being disconnected from said base plate and free to move relative thereto, with said radially inner circumferential edge of said annular supporting member being thereby free to separate from said base plate in response to internal stresses developed on the interior of said tank from liquid contained therein, with said bottom edge of said shell plate being rigidly joined to said annular supporting member along a portion of said supporting member intermediate said radially inner and outer circumferential edges thereof and spaced therefrom, and with said integral joinder of said outer circumferential edge of said annular supporting member to said base plate and said rigid joinder of said bottom edge of said shell plate to said annular supporting member being spaced apart a minimum distance sufficient to cause internal pressure within said tank applied against said upstanding shell plate due to liquids contained within said tank to cause said radially inner circumferential edge of said annular supporting member to separate from said base plate and to be lifted therefrom.

2. A tank according to claim 1 wherein said annular supporting member is formed with a flat planar configuration and wherein said cylindrical shell plate extends perpendicularly thereto; said shell plate being welded to said annular supporting member along said bottom edge thereof by weld beads that extend both on said inner and said outer sides of said shell plate.

3. A tank according to claim 1 wherein said annular supporting member is formed with a cross sectional configuration having an L-shape with a pair of perpendicularly extending legs, one of said legs extending radially inwardly of said base plate and the other of said legs extending perpendicularly therefrom upwardly of said tank with said cylindrical shell plate being attached to said other of said legs.

4. A tank according to claim 1 wherein said annular supporting member is formed with an L-shaped cross sectional configuration having two legs, one of said legs extending generally parallel with said base plate and radially outwardly of said tank with the other of said legs extending perpendicularly to said base plate upwardly therefrom, said cylindrical shell plate being affixed to the other of said legs.

5. A tank according to claim 1 wherein said annular supporting member comprises an inverted T-shaped configuration with two legs extending perpendicularly to each other, one of said T-legs extending parallel to said base plate and being arranged to overlie said base plate and with the other of said legs extending perpendicularly from said one leg intermediate its ends, said cylindrical shell plate being affixed to said other leg.

6. A tank according to claim 1 wherein said radially outer edge of said annular supporting member and said base plate are rigidly affixed to each other by a weld.

7. A tank according to claim 6 wherein said base plate includes a peripheral outer edge which is generally coextensive with said radially outer edge of said annular supporting member, said peripheral edge and said radially outer edge being welded together.

8. A tank according to claim 6 wherein said base plate includes a peripheral outer edge which extends radially outwardly of said radially outer edge of said annular supporting member, said radially outer edge being welded to said base plate at a location radially inwardly of said peripheral outer edge thereof.

9. A tank according to claim 1 wherein said annular supporting member and said base plate are joined together by a bent portion which extends between said radially outer circumferential edge of said annular supporting member and the peripheral outer edge of said base plate as an integral part thereof.

10. A tank according to claim 1 wherein an annular reinforcement plate is provided between said peripheral outer edge of said base plate and said outer circumferential edge of said annular supporting member, said reinforcing plate being welded to both said peripheral edge of said base plate and said radially outer circumferential edge of said annular supporting member.

* * * * *